US010659875B1

(12) United States Patent
Tourbabin et al.

(10) Patent No.: US 10,659,875 B1
(45) Date of Patent: May 19, 2020

(54) TECHNIQUES FOR SELECTING A DIRECT PATH ACOUSTIC SIGNAL

(71) Applicant: Oculus VR, LLC, Menlo Park, CA (US)

(72) Inventors: Vladimir Tourbabin, Sammamish, WA (US); Ravish Mehra, Tacoma, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 15/947,502

(22) Filed: Apr. 6, 2018

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2201/401* (2013.01)

(58) Field of Classification Search
CPC .. H04R 3/005; H04R 1/406; H04R 2201/401; H04R 3/00
USPC ..... 381/92, 385, 91, 355, 376, 381, 388
See application file for complete search history.

(56) References Cited

U.S. PATENT DOCUMENTS

2016/0142830 A1* 5/2016 Hu ..... G02C 11/06 434/185
2017/0257723 A1* 9/2017 Morishita ..... H04R 5/033

OTHER PUBLICATIONS

Nadiri et al., "Localization of Multiple Speakers under High Reverberation using a Spherical Microphone Array and the Direct-Path Dominance Test", IEEE/ACM Transactions on Audio, Speech, and Language Processing, vol. 22, No. 10, Oct. 2014, pp. 1494-1505.
Rafaely et al., "Speaker localization using direct path dominance test based on sound field directivity", Signal Processing, vol. 143, 2018, pp. 42-47.
Hafezi et al., "Multiple Source Localization using Estimation Consistency in the Time-Frequency Domain", IEEE International Conference on Acoustics, Speech and Signal Processing (ICASSP), Mar. 2017, pp. 516-520.
Tourbabin et al., "Speaker Localization by Humanoid Robots in Reverberant Environments", IEEE 28th Convention of Electrical Electronics Engineers (IEEEI), Dec. 2014, 5 pages.
Ding et al., "DOA estimation of multiple speech sources by selecting reliable local sound intensity estimates", Applied Acoustics, vol. 127, 2017, pp. 336-345.
Tourbabin et al., "Theoretical Framework for the Optimization of Microphone Array Configuration for Humanoid Robot Audition", IEEE/ACM Transactions on Audio, Speech, and Language Processing, vol. 22, No. 12, Dec. 2014, pp. 1803-1814.
Maazaoui et al., "Adaptive blind source separation with HRTFs beamforming preprocessing", IEEE 7th Sensor Array and Multichannel Signal Processing Workshop (SAM), Jun. 2012, pp. 269-272.

(Continued)

*Primary Examiner* — Thjuan K Addy
(74) *Attorney, Agent, or Firm* — Artegis Law Group, LLP

(57) ABSTRACT

One embodiment of the present application sets forth a computer-implemented method that includes receiving, from a first microphone, a first input acoustic signal, generating a first audio spectrum from at least the first input acoustic signal, wherein the first audio spectrum includes a set of time-frequency bins, and selecting a first time-frequency bin from the set based on a first local space-domain distance (LSDD) computed for the first time-frequency bin.

20 Claims, 6 Drawing Sheets

(56) References Cited

OTHER PUBLICATIONS

Stoica et al., "Maximum Likelihood Methods for Direction-of-Arrival Estimation", IEEE Transactions on Acoustics, Speech, and Signal Processing, vol. 38, No. 7, Jul. 1990, pp. 1132-1143.
Schmidt, Ralph O., "Multiple Emitter Location and Signal Parameter Estimation", IEEE Transactions on Antennas and Propagation, vol. AP-34, No. 3, Mar. 1986, pp. 276-280.
Harmanci et al., "Relationships between Adaptive Minimum Variance Beamforming and Optimal Source Localization", IEEE Transactions on Signal Processing, vol. 48, No. 1, Jan. 2000, pp. 1-12.
Farina, Angelo, "Simultaneous measurement of impulse response and distortion with a swept-sine technique", Audio Engineering Society Convention, vol. 108, Feb. 2000, pp. 1-24.
EBU SQAM CD, "Sound Quality Assessment Material recordings for subjective tests", EBU Tech 3253, 2008, 13 pages.
Non-Final Office Action received for U.S. Appl. No. 16/215,473 dated Nov. 15, 2019, 10 pages.

* cited by examiner

TECHNIQUES FOR SELECTING A DIRECT PATH ACOUSTIC SIGNAL

BACKGROUND

Field of the Various Embodiments

Embodiments of the present disclosure relate generally to audio processing and, more specifically, to techniques for estimating a direct path acoustic signal.

Description of the Related Art

Near-eye displays (NED) are used in certain instances to simulate virtual environments or to add virtual elements to real environments, such as providing virtual reality (VR), augmented reality (AR), and/or mixed reality (MR) content to a user. When providing AR content to a viewer, the NED provides computer-generated perceptual information in addition to a direct or indirect live view of a physical, real-world environment. When providing AR content to a user, the NED may provide visual, auditory, and haptic content to the computer-generated information.

When providing auditory content in relation to the AR content, a NED may analyze the surrounding acoustic environment in which the NED is located. One technique conventional VR NEDs implement when analyzing an acoustic environment is a direction-of-arrival (DOA) estimation of direct path signal. The NED implements a DOA estimation to determine the direction from which a propagating wave of an acoustic signal arrives at the NED. However, reflections and reverberations within the surrounding acoustic environment make determining the direction of an acoustic source difficult using conventional DOA estimation systems. Furthermore, some systems are computationally demanding in order to accurately perform DOA estimation.

SUMMARY

One embodiment of the present application sets forth a computer-implemented method that includes receiving, from a first microphone, a first input acoustic signal, generating a first audio spectrum from at least the first input acoustic signal, wherein the first audio spectrum includes a set of time-frequency bins, and selecting a first time-frequency bin from the set based on a first local space-domain distance (LSDD) computed for the first time-frequency bin.

At least one advantage of the disclosed embodiments is that the local space domain distance selector provides a technological improvement of effectively selecting time-frequency bins with dominant direct-path signals without requiring computationally-intensive signal processing techniques. By computing the local space-domain distance for each TF bin individually, the local space domain distance selector enables a NED to select one or more TF bins for DOA estimation in an computationally-efficient manner while maintaining accuracy when selecting direct-path dominant TF bins, while not being based on a spherical harmonics (SH) framework, or requiring a spherical array.

BRIEF DESCRIPTION OF THE DRAWINGS

So that the manner in which the above recited features of the various embodiments can be understood in detail, a more particular description of the inventive concepts, briefly summarized above, may be had by reference to various embodiments, some of which are illustrated in the appended drawings. It is to be noted, however, that the appended drawings illustrate only typical embodiments of the inventive concepts and are therefore not to be considered limiting of scope in any way, and that there are other equally effective embodiments.

DETAILED DESCRIPTION

In the following description, numerous specific details are set forth to provide a more thorough understanding of the various embodiments. However, it will be apparent to one of skilled in the art that the inventive concepts may be practiced without one or more of these specific details.

As discussed above, some DOA estimation systems receive input acoustic signals from a microphone array, convert the acoustic signals into the short-time Fourier transform (STFT) domain, and select bins within the time-frequency (TF) domain to process. Some DOA estimation system selects the TF bins dominated by a direct-path signal, while rejecting TF bins that are contaminated with noticeable levels of reflection signals. One of the drawbacks is that selection of the direct-path TF bins is computationally demanding, requiring complex computational steps, such as spherical Fourier transformation and matrix decomposition, to apply direct-path signal determination tests on the TF bins. In addition, these DOA estimation systems impose structural limitations, such as requiring the microphone array to be spherical, in order to accurately perform the DOA estimation systems.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) or near-eye display (NED) connected to a host computer system, a standalone HMD or NED, a mobile device or computing system, or any other hardware platform capable of providing artificial reality content to one or more viewers.

Figure 1:
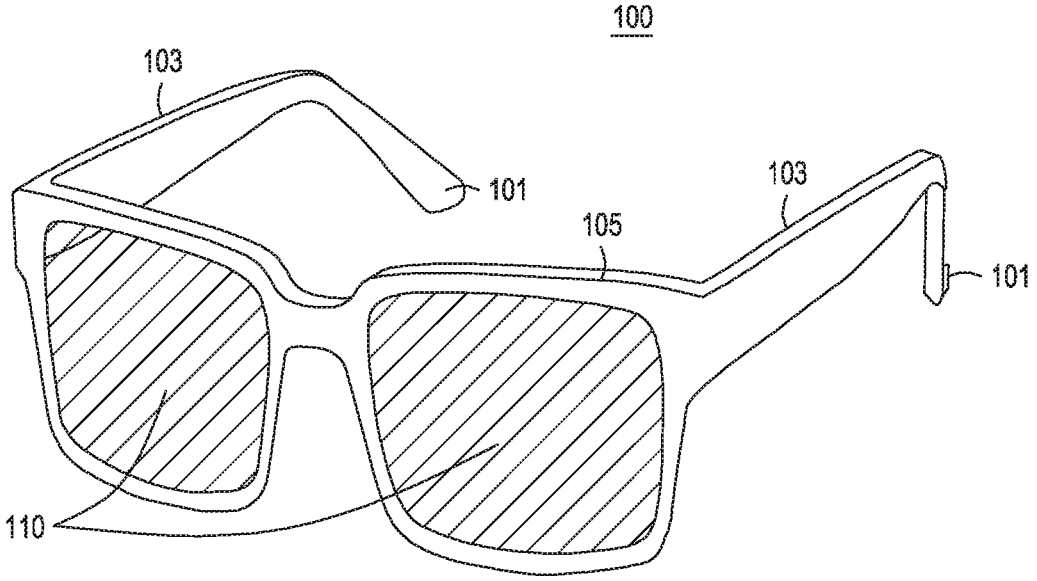
FIG. 1 is an illustration of a near-eye display (NED) configured to implement one or more aspects of the present disclosure.

FIG. 1 is an illustration of a near-eye display (NED) 100 configured to implement one or more aspects of the present disclosure. In various embodiments, NED 100 presents media to a user. The media may include visual, auditory, and haptic content. In some embodiments, NED 100 provides augmented reality (AR) content by providing both a real-world environment and additional computer-generated content. In some embodiments, the computer-generated component of the AR content may include visual, auditory, and haptic information. In some embodiments, auditory information is presented via an external device (e.g., speakers and/or headphones) that receives the auditory information from NED 100.

NED 100 includes headphones 101, microphone array 103, frame 105, and display 110. In various embodiments, the NED 100 may include one or more additional elements. Headphones 101, microphone array 103, and/or display 110 may be positioned at different locations on the NED 100 than the locations illustrated in FIG. 1. Headphones 101 and/or display 110 are configured to provide content to the user, including audiovisual content.

Microphone array 103 includes one or microphones housed within frame 105 of NED 100. Microphone array 103 may be arranged in any number of configurations. Each microphone included in microphone array 103 may be configured to receive audio signals from an environment. In some embodiments, the audio signals may include speech from the user. In some embodiments, the audio signals may include a target, direct-path signal and one or more reflected sound.

Figure 2:
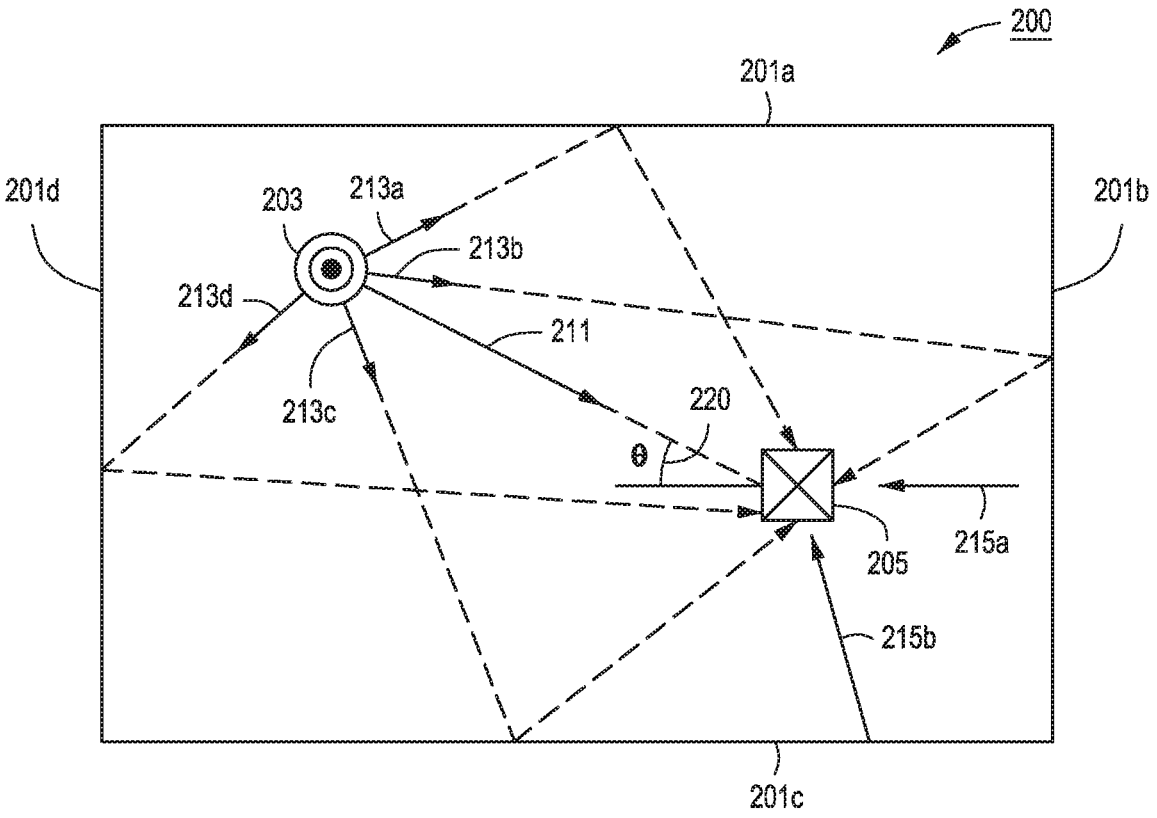
FIG. 2 is an illustration of an acoustic environment including the NED of FIG. 1, according to various embodiments of the present disclosure.

FIG. 2 is an illustration of an acoustic environment 200 including the NED 100 of FIG. 1, according to various embodiments of the present disclosure. Acoustic environment 200 includes walls 201*a-d*, acoustic source 203, and target 205. An audio spectrum in acoustic environment 200 includes direct path acoustic signal 211, reflected path acoustic signals 213*a-d*, and noise signals 215*a-b*.

Acoustic source 203 may be any person, device, or other object that generates a sound within acoustic environment 200. Acoustic source 203 may generate a sound that emanates through a sound propagation wave. The sound propagation wave includes multiple acoustic signals, including direct path acoustic signal 211 that transmits the sound in the direction of target 205. The sound propagation wave also includes one or more reflected path acoustic signals 213*a-d*. Each reflected path acoustic signal may reflect on one or more walls 201*a-d* included in acoustic environment 200 before reaching target 203.

Target 205 may be a user that is operating NED 100. During operation, microphone array 103 of NED 100 may receive acoustic signals 211-215. When implementing an AR application, NED 100 may implement a direction-of-arrival (DOA) estimation to determine the relative direction of direct path signal 211 originating from acoustic source 203. In some embodiments, NED 100 may implement DOA estimation techniques to filter out reflected path acoustic signals 213*a-d* and/or noise signals 215*a-b*. Noise signals 215*a-b* may represent other sounds in acoustic environment 200 that do not originate from acoustic source 203 or target 205.

When NED 100 implements a DOA estimation to determine the direction of direct path signal 211, NED 100 may not be able to filter out all of reflected path acoustic signals 213*a-d* and/or noise signals 215*a-b*. Microphone array 103 in NED 100 may receive an audio spectrum that includes direct path acoustic signal 211, reflected path acoustic signals 213*a-d*, and noise signals 215*a-b*. In such instances, NED 100 may implement spectrum analysis techniques to select one or more portions of the audio spectrum for further processing in order to determine direct-path acoustic signal 211 and determine an angle 220 that indicates the direction of direct-path acoustic signal 211. In some embodiments, NED 100 may use the determined angle 220 to locate acoustic source 203.

Figure 3:
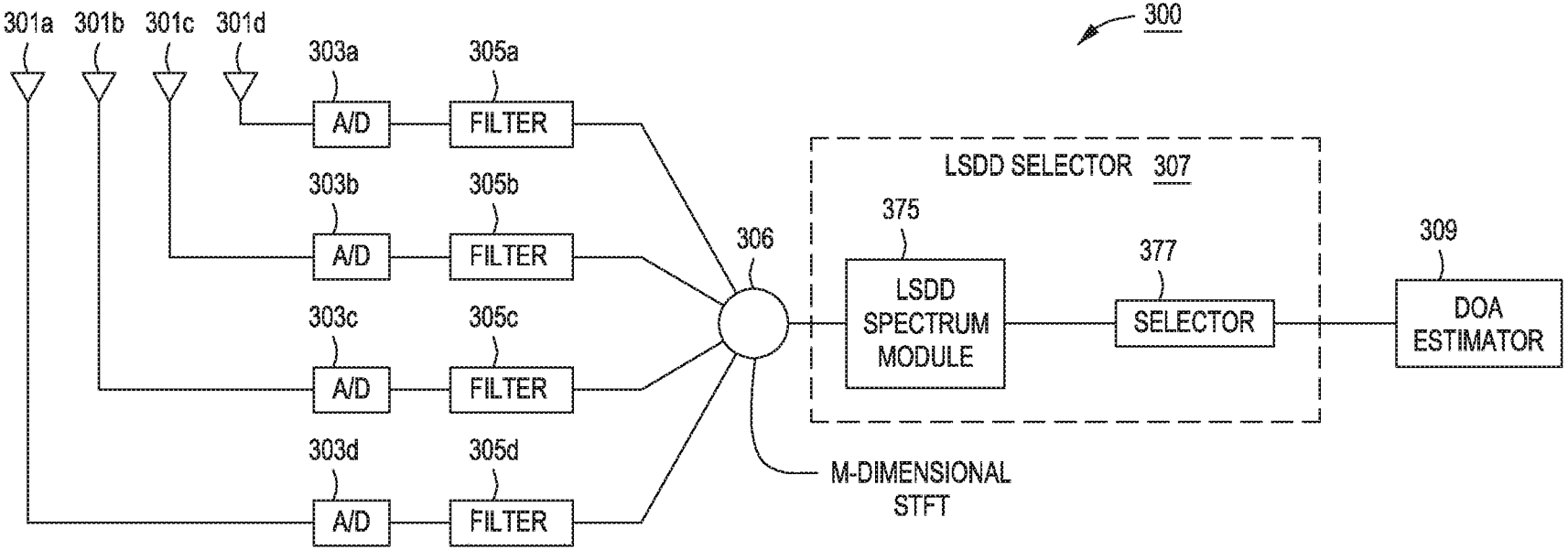
FIG. 3 is a detailed illustration of a direction-of-arrival (DOA) estimation device included in the NED of FIG. 1, according to various embodiments of the present disclosure.

FIG. 3 is a detailed illustration of a direction-of-arrival (DOA) estimation device 300 included in the NED 100 of FIG. 1, according to various embodiments of the present disclosure. DOA estimation device 300 includes microphones 301*a-d*, analog/digital (A/D) converters 303*a-d*, filters 305*a-d*, M-dimensional short-time Fourier transfer (STFT) 306, local space-domain distance (LSDD) selector 307, and DOA estimator 309. The LSDD selector 307 includes an LSDD spectrum module 375 and selector 377.

DOA estimation device 300 may be a component of NED 100 that receives audio signals and determines the direction of direct-path acoustic signal 211 included in the audio spectrum. In some embodiments, DOA estimation device 300 may include hardware and/or software to process the received set of audio signals to determine what part of the received audio signal is the direct-path acoustic signal 211 and also determine the direction of the direct-path acoustic signal 211, where the direction is determined as a relative angle 220 from which microphone array 103 received the direct-path acoustic signal 211.

The front-end of DOA estimation device 300 includes one or more microphones 301*a-d*, one or more A/D converters 303*a-d*, and one or more filters 305*a-d*. In some embodiments, the front end of DOA estimation device 300 may include two or more parallel or substantially-parallel paths, where each parallel path is connected to a separate microphone 301*a-d* in microphone array 103 of NED 100. Each of microphones 301*a-d* may receive multiple audio signals, including direct-path acoustic signal 211, reflected-path acoustic signals 213*a-d*, and/or noise signals 215*a-b*. Each of A/D converters 303*a-d* converts the received audio signal from respective microphone 301*a-d* into a digital signal. Each of filters 305*a-d* may filter some of the digital audio received from respective A/D converters 303*a-d* to remove some noise from the signal. In some embodiments, filters 303*a-d* may be a high-pass filter, a low-pass filter, and/or a bandpass filter.

Short-time Fourier transform (STFT) 306 receives an M-channel signal from filters 303*a-d* and transforms the M-channel signal into the STFT domain. The transform of the M-channel audio signal is the audio spectrum, with each TF bin in the audio spectrum represented as audio/complex-valued vectors. Each vector in the transform includes an array manifold (La, steering vector) reflecting the array response to a unit-amplitude sound wave at a defined frequency arriving at a particular angle. Each vector is also associated with a scalar quantity that denotes the amplitude of the vector arriving at the particular angle. In some embodiments, the scalar quantity includes a source amplitude, one or more reflections, a distance-dependent phase, and a distance-dependent amplitude. The transform includes multiple vectors, with each vector being multiplied by a scalar quantity.

Local space-domain distance (LSDD) selector 307 included in DOA estimation device 300 receives one or more TF bins from M-dimensional STFT 306 and transmits one or more selected time-frequency (TF) bins for DOA estimation by DOA estimator 309. As will be discussed in further detail, M-dimensional STFT 306 receives the separate digital audio signals and generates the audio spectrum. LSDD selector 307 separately processes each of TF bin included in the audio spectrum. For each of the separately-processed TF bins, LSDD selector 307 determines whether the TF bin includes a portion of the audio spectrum with a distinguished direct-path audio signal 211. LSDD selector 307 transmits to DOA estimator 307 the TF bins that include the distinct presence of direct-path acoustic signal 211.

In some embodiments, for a given TF bin, LSDD spectrum module 375 computes a local space-domain distance (LSDD) spectrum. The local space-domain distance for a given TF bin reflects the amplitude of the spatial spectrum as a function of the angle at which microphone array 103 received the acoustic signal. In some embodiments, the angle at which microphone array 103 receives the acoustic signal includes both the elevation angle and azimuth angle. In some embodiments, LSDD spectrum module 375 computes the LSDD as a function of the TF bin, $X_{T,V}$, and the array manifold for the audio signals, $V_V$. Equation 1 illustrates the relationship between LSDD, $S_{T,V}(\theta)$, the TF bin, and the array manifold:

$$S_{\tau,\vartheta}(\theta)=1/d(X_{\tau,\vartheta},V_{\vartheta}(\theta)) \quad (1)$$

In some embodiments, d(X, V) measures the similarity between two vectors, such as the sine of the angle between the two vectors. In some embodiments, an ideal TF bin includes only the direct-path acoustic signal 211, so that d(X, V) for the TF bin is equal to 0 and the LSDD has an infinite peak. In some embodiments, the d(X, V) for a TF bin is small, resulting in a large LSDD value, indicating a TF bin with a dominant direct-path acoustic signal 211.

Selector 377 evaluates each of the TF bins to determine whether to select the TF bin for DOA estimation by DOA estimator 309. Selector 377 evaluates a TF bin by determining a local spectrum value $L_{sp}$ for that TF bin. The $L_{sp}$ for a given TF bin represents a peak-to-noise ratio reflecting a comparative strength of direct-path acoustic signal 211 to other acoustic signals included the LSDD spectrum within a given TF bin. Unlike other methods that average the local spectrum value across all TF bins, selector 377 computes each local spectrum value separately. Selector 377 then uses the computed local spectrum value to determine whether the given TF bin should be transmitted to DOA estimator 309 for further processing. When determining whether the given TF bin should be transmitted to DOA estimator 309, selector 377 compares the local spectrum value to a pre-determined threshold to determine whether the local spectrum value exceeds the pre-determined threshold. When the local spectrum value exceeds the pre-determined threshold, selector 377 may transmit the given TF bin to DOA estimator 309.

DOA estimator 309 implements a DOA estimation on the TF bin received from LSDD selector 307. In some embodiments, DOA estimator may compile the estimated direction computed for each received TF bin to compute an estimated angle 220. In some embodiments, the computation of spatial spectra for all TF bins may be implemented in parallel. In some embodiments, DOA estimator 309 may transmit estimated angle 220 to a different component of NED 100, which may incorporate estimated angle 220 when implementing an AR application.

Figure 4:
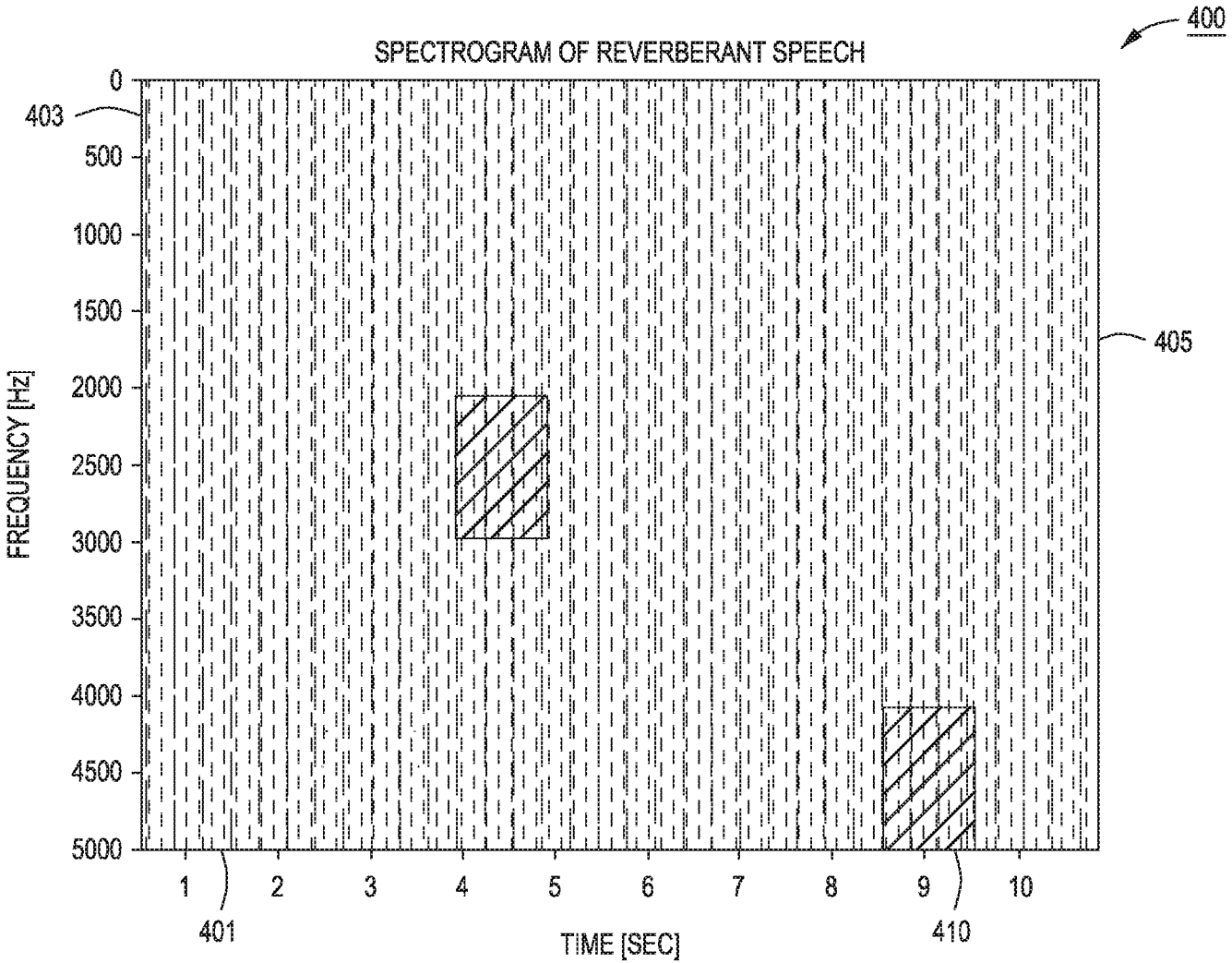
FIG. 4 is an illustration of a selected time-frequency (TF) bin from the acoustic spectrum, according to various embodiments of the present disclosure.

FIG. 4 is an illustration of a selected time-frequency (TF) bin from the audio spectrum, according to various embodiments of the present disclosure. Graph 400 includes a spectrograph of the audio spectrum 405 as a function of time 401 and frequency 403. TF bin 410 includes a portion of audio spectrum 405 for processing by LSDD spectrum module 375 and/or selector 377 of LSDD selector 307.

As discussed above, M-dimensional STFT 306 generates audio spectrum 405. In some embodiments, audio spectrum 405 may include the audio spectrum of the audio signals received by microphone array 103. In some embodiments, each TF bin 410 of audio spectrum 405 includes one or more of direct-path acoustic signal 211, reflected-path acoustic signals 213*a-d*, and/or noise signals 215*a-b*. In some embodiments, each TF bin 410 has differing concentrations of each of the respective audio signals 211-215. Selector 377 of LSDD selector 307 is configured to separately process each of TF bins 410 and select only the TF bins that have a high relative concentration of direct-path acoustic signal 211. In some embodiments, DOA estimator 309 may implement DOA estimations on only the TF bins 410 selected by LSDD selector 307 to generate an estimated angle 220 of acoustic source 203.

Figure 5:
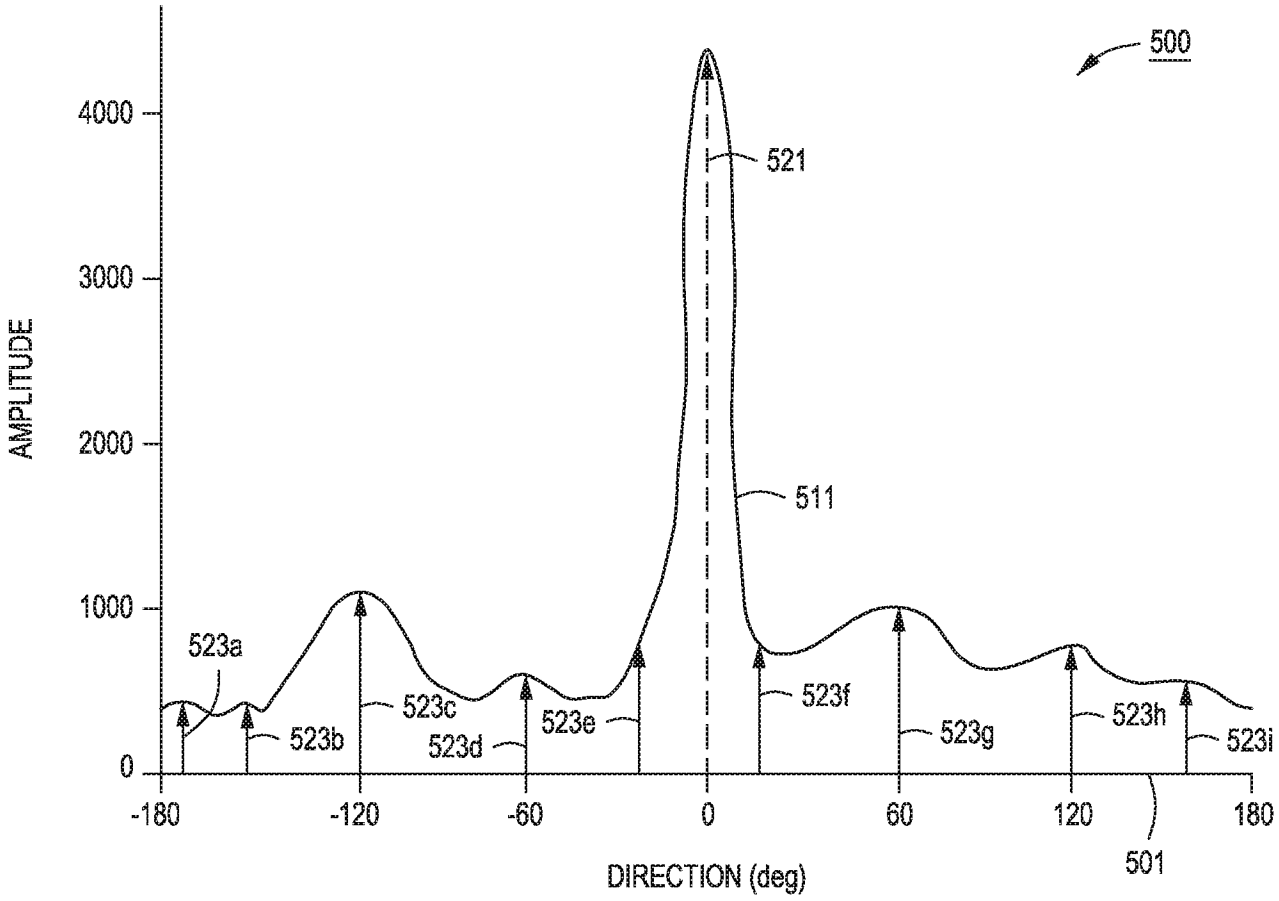
FIG. 5 is an illustration a local space-domain distance (LSDD) estimation for a target TF bin of FIG. 4, according to various embodiments of the present disclosure.

FIG. 5 is an illustration of a local space-domain distance (LSDD) spectrum for a given TF bin 410 of FIG. 4, according to various embodiments of the present disclosure. Graph 500 includes LSDD (spatial) spectrum 511 as a function of acoustic source direction 501 (x axis) and amplitude 503 (y axis). LSDD spectrum 511 includes a maximum peak 521 and a set of secondary peaks 523*a-i*.

In some embodiments, LSDD spectrum module 375 computes local space-domain distance (LSDD) spectrum 511 for a given TF bin 410 received from M-dimensional STFT 306. Upon computing LSDD spectrum 511, LSDD spectrum module 375 transmits the TF bin including the LSDD spectrum 511 to selector 377. When selector 377 determines whether to transmit the given TF bin 410 to DOA estimator 309, selector 377 first computes a local spectrum value for the LSDD spectrum 511. Selector 377 then compares the local spectrum value to a pre-determined threshold.

In some embodiments, when computing the local spectrum value, selector 377 determines the maximum peak 521 of LSDD spectrum 511, along with a set of secondary peaks 523*a-i*. In such instances, the local spectrum value is similar to a peak-to-noise ratio for LSDD spectrum 511, reflecting the comparative strength of direct-path acoustic signal 211 to other signals and noise in LSDD spectrum 511. Equation 2 illustrates the local spectrum value as a ratio of the maximum peak 521 of the scalar quantity, $S_{max}$, compared to the average of secondary peaks 523*a-i* of the scalar quantity, $S(\theta_i)$, where $S_{min}$ is the minimum value of the scalar quantity for LSDD spectrum 511:

$$L_{sp} = \frac{S_{max} - S_{min}}{\frac{\sum S(\theta_i) - S_{max}}{N} - S_{min}} \quad (2)$$

In some embodiments, selector 377 may compare the computed local spectrum value to a pre-determined threshold. In some embodiments, selector 377 may compare a different value based on the local spectrum value to the pre-determined threshold. For example, selector 377 may compute a confidence value, which reflects the ground-truth direct-t-reverberant ratio (DRR). In some embodiments, the confidence value may be a function of the local spectrum value, similar to a decibel value. The confidence value is illustrated in Equation 3:

$$C=20\log_{10}(L_{sp}) \quad (3)$$

In some embodiments, DOA estimation device 300 may store the pre-determined threshold as a quantity, such as 10, requiring a local spectrum value of at least 10 for selector 377 of LSDD selector 307 to select the target TF bin 410 to be transmitted to DOA estimator 309.

Figure 6:
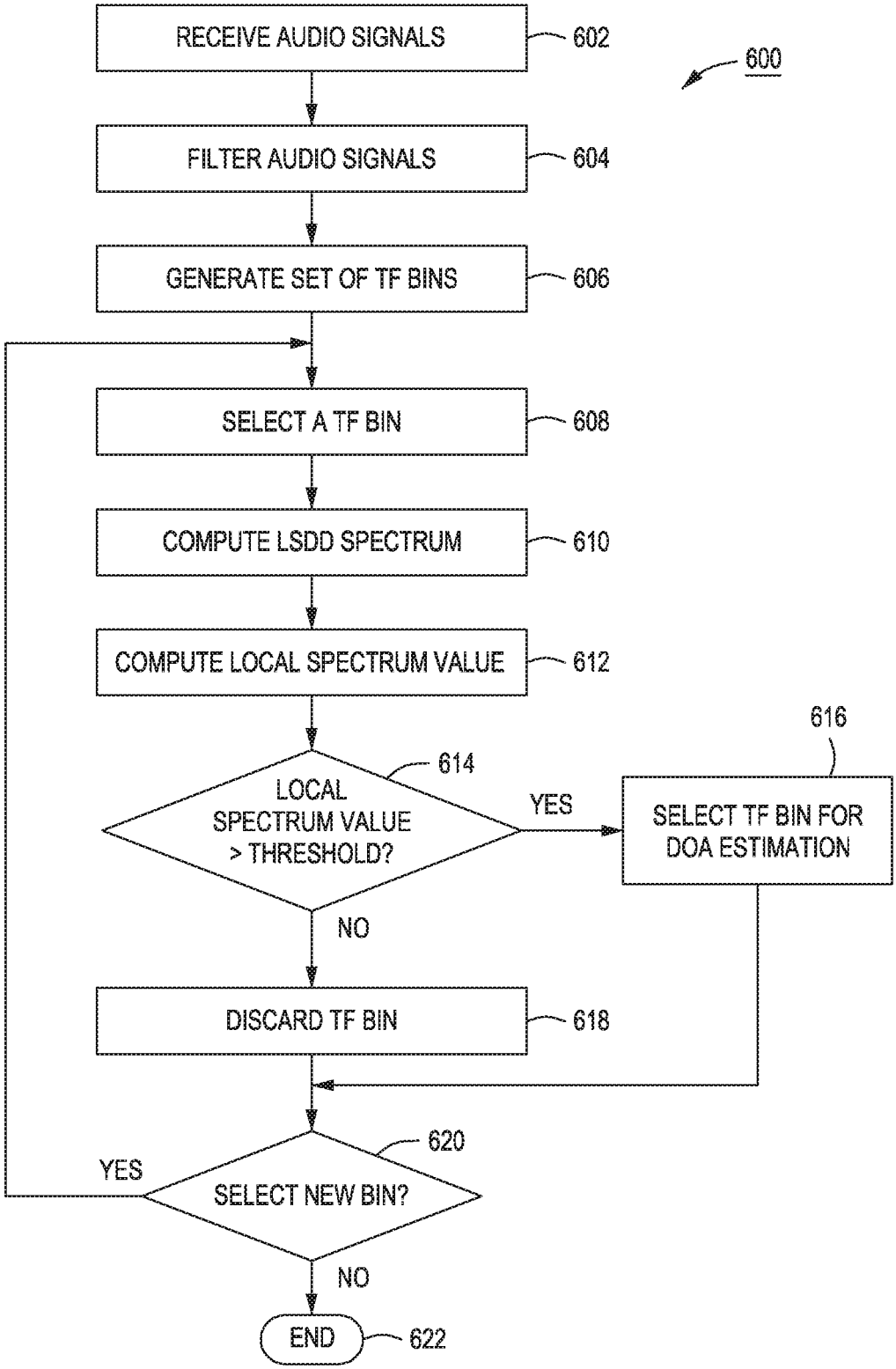
FIG. 6 sets forth a flow diagram of method steps for selecting a TF bin for DOA estimation, according to various embodiments of the disclosure.

FIG. 6 sets forth a flow diagram of method steps for selecting a TF bin for DOA estimation, according to various embodiments of the disclosure. Although the method steps are described with reference to the systems of FIGS. 1-5, persons skilled in the art will understand that the method steps can be performed in any order by any system.

Method 600 begins at steps 602, where DOA estimation device 300 receives an input audio signal. In some embodiments, microphone array 103 of NED 100 may receive multiple acoustic signals as the input audio signal. In some embodiments, microphone array 103 may receive the acoustic signals as a continuous signal. In alternative embodiments, microphone array 103 may receive the acoustic signals as discrete signals. In some embodiments, microphone array 103 receives audio spectrum that includes direct-path acoustic signal 211, reflected-path acoustic signals 213*a-d*, and noise signals 215*a-b*.

At step 604, DOA estimation device 300 may optionally filter the input audio signal. In some embodiments, each parallel path in the front-end of DOA estimation device 300 may include a filter 305*a-d* that receives a digital signal from an analog-to-digital converter 303*a-d*. Each of filters 305*a-d* may filter some of the digital audio received from respective A/D converters 303*a-d* to remove some noise from the signal. In some embodiments, filters 303*a-d* may be a high-pass filter, a low-pass filter, and/or a bandpass filter.

At step 606, DOA estimation device 300 generates a set of TF bins 410. In some embodiments, DOA estimation device 300 may implement M-dimensional STFT 306 to generate an audio spectrum 405 that includes a set of TF bins 410. In some embodiments, each of TF bins 410 includes an equal portion of the frequency range and/or an equal portion of the time frame of the spatial spectrum 405. For example, each of TF bins 410 may include a spatial spectrum within a frequency range of 1000 Hz and a time range of 2 seconds.

At step 608, DOA estimation device 300 selects a given TF bin 410 for processing. In some embodiments, DOA estimation device 300 may implement LSDD selector 307 to successively process each of the set of TF bins 410 generated in step 606 in order to select a set of target TF bins 410 for DOA estimation by DOA estimator 309.

At step 610, DOA estimation device 300 computes a LSDD spectrum 511 for the given TF bin 410. In some embodiments, LSDD spectrum module 375 of LSDD selector 307 may compute a LSDD spectrum 511 within the given TF bin 410 that reflects the amplitude of a signal as a function of the angle at which microphone array 103 received the acoustic signal. In some embodiments, LSDD spectrum module 375 computes LSDD spectrum 511 by computing a LSDD value for each angle included in the given TF bin 410 for a specified frequency.

At step 612, DOA estimation device 300 computes a local spectrum value. In some embodiments, selector 377 of LSDD selector 307 may compute the local spectrum value by first determining the maximum peak 521 of the LSDD spectrum 511, along with a set of secondary peaks 523*a-i* of LSDD spectrum 511. In some embodiments, the local spectrum value is a peak-to-noise ratio reflecting the comparative strength of direct-path acoustic signal 211 to other acoustic signals (e.g., reverberant-path acoustic signals 213*a-d* and/or noise signals 215*a-b*) included in the LSDD spectrum 511 within the given TF bin 410. In some embodiments, DOA estimation device 300 may implement selector 377 to compute the local spectrum value as a ratio of highest peak 521 of the scalar quantity for LSDD spectrum 511 compared to secondary peaks 523*a-i* of the scalar quantity for LSDD spectrum 511.

At step 614, DOA estimation device 300 compares the local spectrum value to a pre-determined threshold. In some embodiments, selector 377 may compare the local spectrum value computed in step 610 and to a pre-determined threshold. In some embodiments, DOA estimation device 300 may store the pre-determined threshold as a quantity, such as 10, requiring a local spectrum value of at least 10 for selector 377 of LSDD selector 307 to select the given TF bin 410 for DOA estimation. When selector 377 determines that the local spectrum value exceeds the pre-determined threshold, DOA estimation device 300 proceeds to step 616; otherwise DOA estimation device 300 proceeds to step 618, where DOA estimation device 300 discards the given TF bin 410.

At step 616, DOA estimation device 300 selects the given TF bin 410 for DOA estimation. In some embodiments, selector 377 of LSDD selector 307 selects the given TF bin 410 for DOA estimation of its LSDD spectrum 511 by DOA estimator 309. In some embodiments, LSDD selector 307 may store each of the TF bins 410 selected by LSDD selector 307 for further processing, and then send the set of TF bins 410 to DOA estimator 309 for DOA estimation. In some embodiments, LSDD selector 307 sends a selected TF bin 410 and causes DOA estimator 307 to perform the DOA estimation of the selected TF bin 410 in parallel with LSDD selector 307 processing the next given TF bin 410, as described in step 608.

At step 620, DOA estimation device 300 determines whether to select a new given TF bin 410. When DOA estimation device 300 determines that additional TF bins 410 remain for processing, DOA estimation device 300 proceeds to step 608, where DOA estimation device 300 selects one of the remaining TF bins 410 for processing via LSDD spectrum module 306. Otherwise, when DOA estimation device 300 determines that no TF bins 410 remain for further processing, DOA estimation device ends method 600 at step 622.

In sum, embodiments of the present disclosure are directed towards a virtual reality near eye device that includes a direction-of-arrival estimation device for estimating a direction of an acoustic signal. The NED includes a microphone array that receives multiple acoustic signals in an environment. The acoustic signals include a direct-path acoustic signal and one or more reverberant-path acoustic signals. An STFT receives the acoustic signals from the microphone array and transforms the acoustic signals into an audio spectrum. The local-space domain distance (LSDD) selector processes a given time-frequency (TF) bin of the audio spectrum. For the given TF bin, an LSDD spectrum module calculates the LSDD spectrum as a function of angles at which the microphone array received acoustic signals. A selector in the LSDD selector computes a local spectrum value for the LSDD spectrum by comparing the maximum peak of the LSDD spectrum to other peaks of the LSDD spectrum. The selector then compares the local spectrum value to a pre-determined threshold, selecting the given TF bin for DOA estimation when the local spectrum value exceeds the pre-determined threshold.

At least one advantage of the disclosed embodiments is that the local space domain distance selector provides a technological improvement over previous DOA estimation systems that would select TF bins based on spherical harmonics domain representations of the received acoustic signals. The LSDD selector enables a NED to effectively select time-frequency bins containing portions of the spatial spectrum containing a dominant direct-path acoustic signal without requiring computationally-intensive signal processing techniques. By computing the LSDD spectrum for each TF bin individually, the LSDD selector enables a NED to select one or more TF bins for DOA estimation in a computationally-efficient manner while maintaining accuracy.

1. In some embodiments, a computer-implemented method comprises receiving, from a first microphone, a first input acoustic signal, generating a first audio spectrum from at least the first input acoustic signal, wherein the first audio spectrum includes a set of time-frequency bins, and selecting a first time-frequency bin from the set based on a first local space-domain distance (LSDD) computed for the first time-frequency bin.

2. The computer-implemented method of clause 1, wherein selecting the first time-frequency bin from the set comprises computing a first local spectrum value from the first LSDD, and selecting the first time-frequency bin when the first local spectrum value exceeds a predetermined threshold.

3. The computer-implemented method of clause 1 or 2, which further comprises performing a direction of arrival (DOA) estimation on the first time-frequency bin to determine a first estimated direction of the first input acoustic signal.

4. The computer-implemented method of any of clauses 1-3, which further comprises selecting a second time-frequency bin in the set based on a second LSDD computed for the second time-frequency bin, wherein the second time-frequency bin is selected when a second local spectrum value computed from the second LSDD exceeds the predetermined threshold.

5. The computer-implemented method of any of clauses 1-4, which further comprises performing a DOA estimation on the second time-frequency bin to generate a second estimated direction of the first input acoustic signal, and determining a first direction for the first input acoustic signal based at least on the first estimated direction and the second estimated direction.

6. The computer-implemented method of any of clauses 1-5, wherein the local spectrum value comprises a direct-to-reverberant ratio (DRR) based on a ratio of a maximum peak value of the first LSDD compared to an average peak value of the first LSDD.

7. The computer-implemented method of any of clauses 1-6, wherein the predetermined threshold is equal to a multiple of an average peak value of the first LSDD.

8. The computer-implemented method of any of clauses 1-7, wherein generating a first audio spectrum from the first input acoustic signal comprises generating a short-time Fourier transform (STFT) from the first input acoustic signal.

9. The computer-implemented method of any of clauses 1-8, wherein the microphone is included in a wearable headset.

10. In some embodiments, a wearable device comprises a microphone array that receives a first input acoustic signal, and a controller that generates a first audio spectrum from at least the first input acoustic signal, wherein the first audio spectrum includes a set of time-frequency bins, selects a first time-frequency bin from the set based on a local space-domain distance (LSDD) computed for the first time-frequency bin, and performs a direction of arrival (DOA) estimation on the first time-frequency bin to determine a first estimated direction of the first input acoustic signal.

11. The wearable device of clause 10, wherein the microphone array comprises two or more distinct microphones at different locations on the wearable device.

12. The wearable device of clause 10 or 11, wherein the two or more distinct microphones receive at least two or more acoustic signals, and the controller adds the two or more acoustic signals to generate the first input acoustic signal.

13. The wearable device of any of clauses 10-12, wherein selecting the first time-frequency bin from the set comprises computing a first local spectrum value from the first LSDD, and selecting the first time-frequency bin when the first local spectrum value exceeds a predetermined threshold.

14. The wearable device of any of clauses 10-13, wherein the controller selects a second time-frequency bin in the set based on a second LSDD computed for the second time-frequency bin, wherein the second time-frequency bin is selected when a second local spectrum value computed from the second LSDD exceeds the predetermined threshold.

15. The wearable device of any of clauses 10-14, wherein the controller performs a DOA estimation on the second time-frequency bin to generate a second estimated direction of the first input acoustic signal, and determines a first direction for the first input acoustic signal based at least on the first estimated direction and the second estimated direction.

16. The wearable device of any of clauses 10-15, wherein the local spectrum value comprises a direct-to-reverberant ratio (DRR) based on a ratio of a maximum peak value of the first LSDD compared to an average peak value of the first LSDD.

17. The wearable device of clauses any of 10-16, wherein the predetermined threshold has a value equal to a multiple of an average peak value of the first LSDD.

18. The wearable device of clauses any of 10-17, wherein the controller generates the first audio spectrum from the first input acoustic signal by generating a short-time Fourier transform (STFT) from the first input acoustic signal.

19. In some embodiments, a non-transitory computer-readable storage medium storing instructions, which, when executed by a processor, perform a set of operations that comprises receiving a first input acoustic signal, generating a first audio spectrum from at least the first input acoustic signal; wherein the first audio spectrum includes a set of time-frequency bins, and selecting a first time-frequency bin from the set based on a first local space-domain distance (LSDD) computed within the first time-frequency bin.

20. The non-transitory computer-readable storage medium of clause 19, wherein selecting the first time-frequency bin from the set comprises computing a first local spectrum value from the first LSDD, and selecting the first time-frequency bin when the first local spectrum value exceeds a predetermined threshold.

Any and all combinations of any of the claim elements recited in any of the claims and/or any elements described in this application, in any fashion, fall within the contemplated scope of the present disclosure and protection.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine. The instructions, when executed via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A computer-implemented method, comprising:

receiving, from a first microphone, a first input acoustic signal;

generating a first audio spectrum from at least the first input acoustic signal, wherein the first audio spectrum includes a set of time-frequency bins; and selecting a first time-frequency bin from the set based on a first local space-domain distance (LSDD) computed for the first time-frequency bin.

2. The computer-implemented method of claim 1, wherein selecting the first time-frequency bin from the set comprises:

computing a first local spectrum value from the first LSDD, and selecting the first time-frequency bin when the first local spectrum value exceeds a predetermined threshold.

3. The computer-implemented method of claim 1, further comprising performing a direction of arrival (DOA) estimation on the first time-frequency bin to determine a first estimated direction of the first input acoustic signal.

4. The computer-implemented method of claim 1, further comprising selecting a second time-frequency bin in the set based on a second LSDD computed for the second time-frequency bin, wherein the second time-frequency bin is selected when a second local spectrum value computed from the second LSDD exceeds the predetermined threshold.

5. The computer-implemented method of claim 4, further comprising:

performing a DOA estimation on the second time-frequency bin to generate a second estimated direction of the first input acoustic signal; and determining a first direction for the first input acoustic signal based at least on the first estimated direction and the second estimated direction.

6. The computer-implemented method of claim 2, wherein the local spectrum value comprises a direct-to-reverberant ratio (DRR) based on a ratio of a maximum peak value of the first LSDD compared to an average peak value of the first LSDD.

7. The computer-implemented method of claim 2, wherein the predetermined threshold is equal to a multiple of an average peak value of the first LSDD.

8. The computer-implemented method of claim 1, wherein generating a first audio spectrum from the first input acoustic signal comprises generating a short-time Fourier transform (STFT) from the first input acoustic signal.

9. The computer-implemented method of claim 1, wherein the microphone is included in a wearable headset.

10. A wearable device, comprising:

a microphone array that receives a first input acoustic signal; and a controller that:

generates a first audio spectrum from at least the first input acoustic signal, wherein the first audio spectrum includes a set of time-frequency bins, selects a first time-frequency bin from the set based on a local space-domain distance (LSDD) computed for the first time-frequency bin, and performs a direction of arrival (DOA) estimation on the first time-frequency bin to determine a first estimated direction of the first input acoustic signal.

11. The wearable device of claim 10, wherein the microphone array comprises two or more distinct microphones at different locations on the wearable device.

12. The wearable device of claim 11, wherein:

the two or more distinct microphones receive at least two or more acoustic signals; and the controller adds the two or more acoustic signals to generate the first input acoustic signal.

13. The wearable device of claim 10, wherein selecting the first time-frequency bin from the set comprises:

computing a first local spectrum value from the first LSDD; and selecting the first time-frequency bin when the first local spectrum value exceeds a predetermined threshold.

14. The wearable device of claim 10, wherein the controller selects a second time-frequency bin in the set based on a second LSDD computed for the second time-frequency bin, wherein the second time-frequency bin is selected when a second local spectrum value computed from the second LSDD exceeds the predetermined threshold.

15. The wearable device of claim 14, wherein the controller:

performs a DOA estimation on the second time-frequency bin to generate a second estimated direction of the first input acoustic signal; and determines a first direction for the first input acoustic signal based at least on the first estimated direction and the second estimated direction.

16. The wearable device of claim 10, wherein the local spectrum value comprises a direct-to-reverberant ratio (DRR) based on a ratio of a maximum peak value of the first LSDD compared to an average peak value of the first LSDD.

17. The wearable device of claim 11, wherein the predetermined threshold has a value equal to a multiple of an average peak value of the first LSDD.

18. The wearable device of claim 10, wherein the controller generates the first audio spectrum from the first input acoustic signal by generating a short-time Fourier transform (STFT) from the first input acoustic signal.

19. A non-transitory computer-readable storage medium storing instructions, which, when executed by a processor, perform a set of operations comprising:

receiving a first input acoustic signal;

generating a first audio spectrum from at least the first input acoustic signal;

wherein the first audio spectrum includes a set of time-frequency bins; and selecting a first time-frequency bin from the set based on a first local space-domain distance (LSDD) computed within the first time-frequency bin.

20. The non-transitory computer-readable storage medium of claim 19, wherein selecting the first time-frequency bin from the set comprises:

computing a first local spectrum value from the first LSDD, and selecting the first time-frequency bin when the first local spectrum value exceeds a predetermined threshold.

* * * * *